US012736038B2

(12) United States Patent
Yokota

(10) Patent No.: US 12,736,038 B2
(45) Date of Patent: Sep. 15, 2026

(54) HYDRAULIC MOTOR

(71) Applicant: NACHI-FUJIKOSHI CORP., Tokyo (JP)

(72) Inventor: Takaya Yokota, Toyama (JP)

(73) Assignee: NACHI-FUJIKOSHI CORP., Tokyo (JP)

( * ) Notice: Subject to any disclaimer, the term of this patent is extended or adjusted under 35 U.S.C. 154(b) by 0 days.

(21) Appl. No.: 19/373,770

(22) Filed: Oct. 30, 2025

(65) Prior Publication Data

US 2026/0126032 A1 May 7, 2026

(30) Foreign Application Priority Data

Nov. 6, 2024 (JP) ..... 2024-194479

(51) Int. Cl.
*F04B 1/2064* (2020.01)
*F04B 1/324* (2020.01)

(52) U.S. Cl.
CPC ..... *F04B 1/2064* (2013.01); *F04B 1/324* (2013.01); *F04B 2201/0805* (2013.01)

(58) Field of Classification Search
CPC . F04B 1/2064; F04B 1/324; F04B 2201/0805
See application file for complete search history.

(56) References Cited

U.S. PATENT DOCUMENTS 5,141,402 A * 8/1992 Bloomquist ..... H02K 17/30 417/217
5,554,007 A * 9/1996 Watts ..... F04B 1/324 91/504
6,102,490 A * 8/2000 Ko ..... B60T 1/10 303/10
7,124,677 B2 * 10/2006 Kadlicko ..... F01B 3/0035 92/12.2
8,677,884 B2 * 3/2014 Ogasawara ..... F01P 5/04 91/1
11,168,709 B2 * 11/2021 Okada ..... G01P 3/487
11,946,462 B2 * 4/2024 Tvaruzek ..... F04B 1/2021
2011/0083553 A1 * 4/2011 Duerr ..... F04B 1/328 92/5 R

FOREIGN PATENT DOCUMENTS

DE 102024208967 A1 * 3/2026 ..... F04B 1/20
JP 7281918 B2 8/2020

* cited by examiner

*Primary Examiner* — Michael Leslie
(74) *Attorney, Agent, or Firm* — Apex Juris, pllc

(57) ABSTRACT

A configuration of a hydraulic motor according to the present disclosure includes: a cylinder barrel rotatably supported in a housing together with a shaft; a plurality of pistons slidably inserted into the cylinder barrel in an axial direction; a swash plate for changing strokes of the pistons; a control piston for adjusting an angle of the swash plate; a valve body provided with an inflow port and an outflow port; a female thread formed at an end portion of the shaft of the cylinder barrel on a valve body side; a shaft member (hexagonal bolt) having irregularities on an outer peripheral portion and attached to the female thread; and a sensor disposed between the inflow port and the outflow port and detecting the irregularities of the shaft member.

3 Claims, 6 Drawing Sheets

HYDRAULIC MOTOR

CROSS-REFERENCE TO RELATED APPLICATION

This application is based upon and claims the benefit of priority from Japanese Patent Application No. 2024-194479, filed Nov. 6, 2024; the entire contents of which are incorporated herein by reference.

BACKGROUND OF THE INVENTION

Field of the Invention

The present invention relates to a hydraulic motor.

Background Art

Hydraulic motors, which are employed as driving power sources for traveling or for slewing, are used in construction machines and industrial machines. A hydraulic motor is provided with a sensor that detects a rotation of the motor. For example, Patent Document 1 discloses "a hydraulic motor including a casing, a cylinder block accommodated in the casing and capable of rotating, a cylinder block-side friction plate, rotation of which relative to the cylinder block about a rotation axis of the cylinder block is restricted, a casing-side plate, rotation of which relative to the casing is restricted, at least partially overlapping with the cylinder block-side friction plate in a rotational axis direction, a pressing mechanism that presses the cylinder-block-side friction plate and the casing-side plate against each other along the rotation axis direction, and a detector fixed to the casing and detecting rotation of at least one of the cylinder-block-side friction plates."

Patent Document 1: Japanese U.S. Pat. No. 7,281,918

SUMMARY OF THE INVENTION

The hydraulic motor of Patent Document 1 includes the detector for detecting rotation of the cylinder block-side friction plate. The detector is provided in a fixing block of the casing on an outer peripheral side of the cylinder block. With this configuration, the detector is arranged at a position away from a piping port portion of a valve body that performs hydraulic piping of the hydraulic motor, so that the position and orientation/direction of the hydraulic piping and wiring of the detector become inconsistent. As a result, when the hydraulic motor is assembled into a construction machine or the like, there arises a problem in that routing of the piping and wiring becomes complicated.

The present disclosure has been made in view of foregoing problems. it is desirable to improve the efficiency of routing of piping and wiring when providing a sensor for detecting the rotation of the motor.

A representative configuration of a hydraulic motor according to the present disclosure includes: a cylinder barrel rotatably supported in a housing together with a shaft; a plurality of pistons slidably inserted into the cylinder barrel in an axial direction; a swash plate for changing strokes of the pistons; a control piston for adjusting an angle of the swash plate; a valve body provided with an inflow port and an outflow port; a female thread formed at an end portion of the shaft of the cylinder barrel on a valve body side; a shaft member having irregularities on an outer peripheral portion thereof and attached to a female thread; and a sensor disposed between the inflow port and the outflow port and detecting the irregularities of the shaft member.

The connection direction of the hydraulic piping of the inflow port and the outflow port may be the same as a connection direction of wiring of the sensor.

A maximum diameter of the irregularities on the outer peripheral portion of the shaft member may be smaller than a diameter of the shaft.

DETAILED DESCRIPTION

Figure 1A:
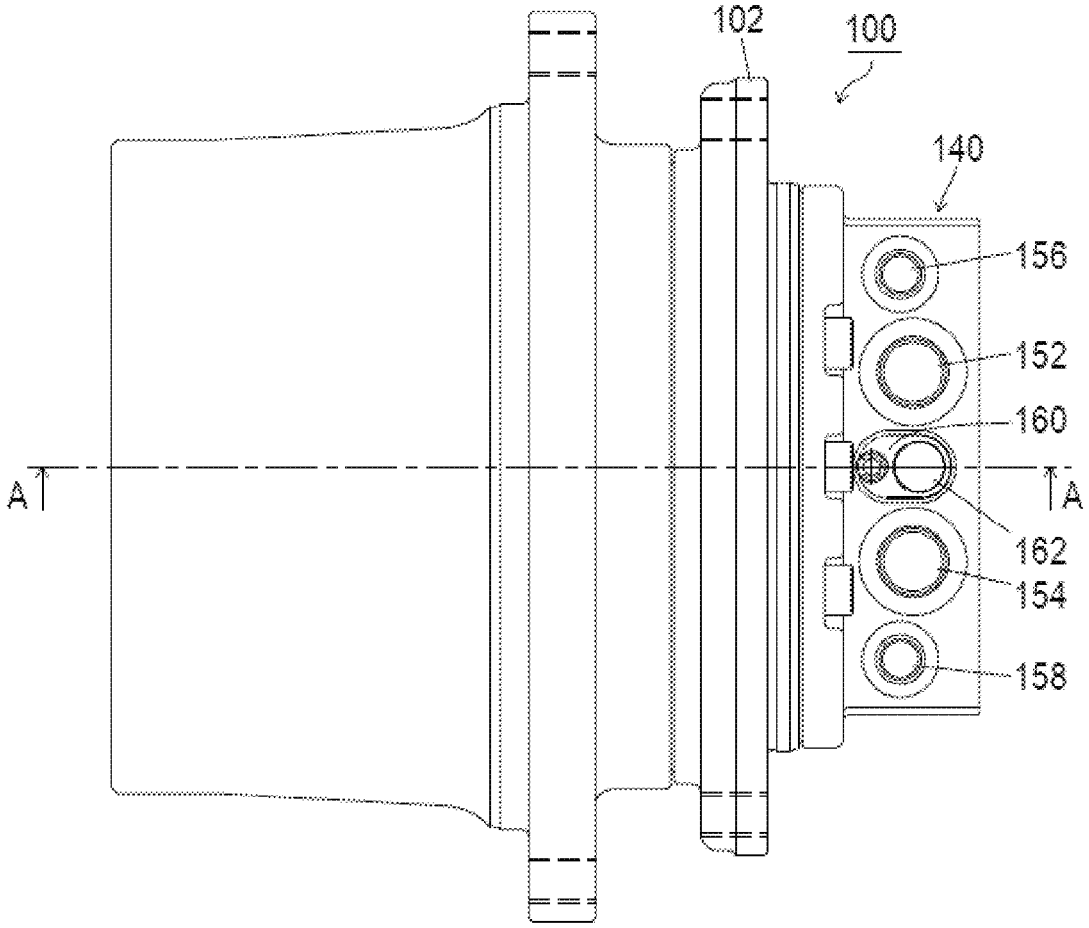
FIG. 1A is a diagram illustrating a hydraulic motor according to an embodiment of the present disclosure.

The embodiments will be described in detail below with reference to the accompanying drawings. The dimensions, materials, and other specific numerical values shown in the embodiments are merely examples for facilitating understanding of the invention, and unless otherwise specified, do not limit the embodiments. In the present specification and drawings, elements having substantially the same functions and configurations are denoted by the same reference numerals so that redundant descriptions are omitted, and elements not directly related to the embodiments are omitted from illustration or description.

Figure 1B:
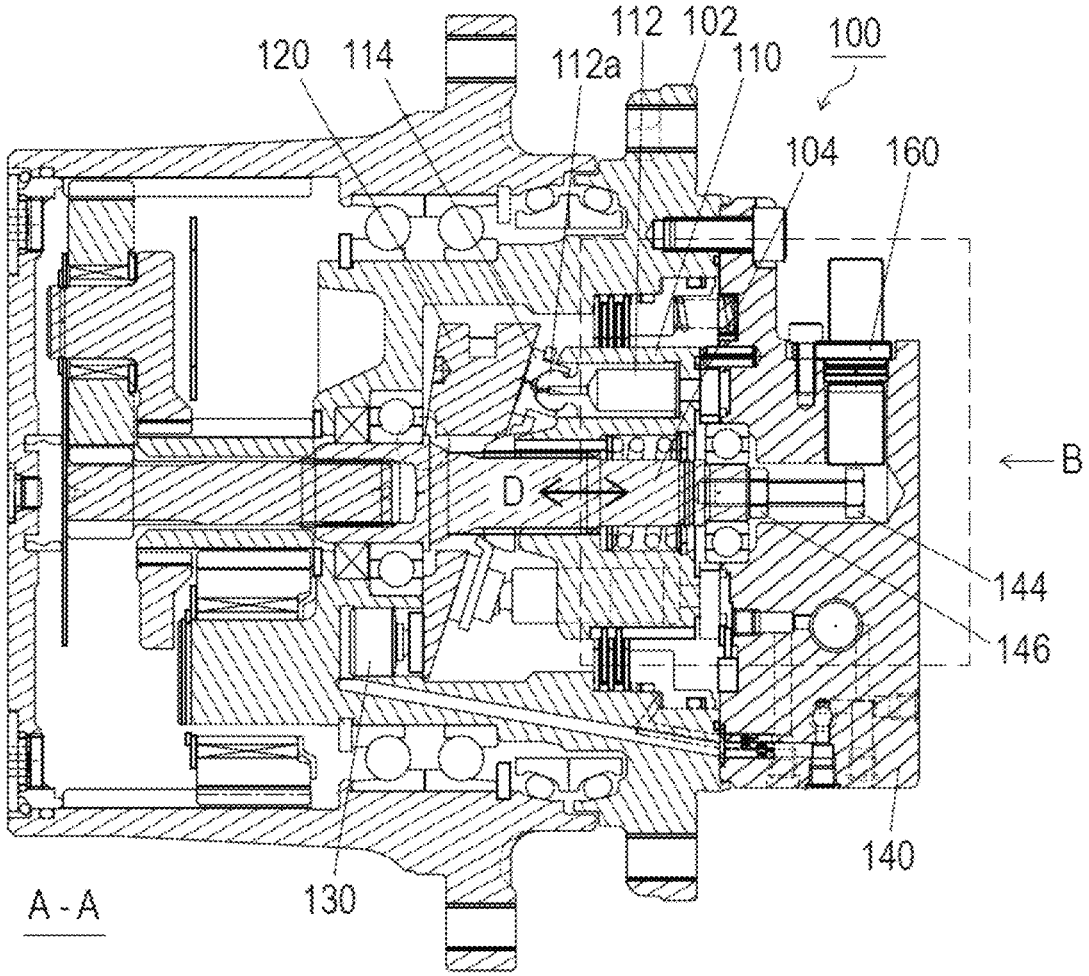
FIG. 1B is a sectional view taken along line A-A of FIG. 1A.

FIG. 1 is a diagram illustrating a hydraulic motor 100 according to an embodiment of the present disclosure. FIG. 1A is a top view of the hydraulic motor 100. FIG. 1B is a sectional view taken along line A-A of the hydraulic motor 100. FIG. 1B is also a side sectional view illustrating the internal structure of the hydraulic motor 100.

The hydraulic motor 100 shown in FIGS. 1A and 1B is used as a drive source for traveling in construction machinery, industrial machinery, and the like. As shown in FIG. 1A, the hydraulic motor 100 of the present embodiment includes a housing 102 and a valve body 140 provided adjacent to the housing 102.

The valve body 140 is provided with two ports 152 and 154, each functioning as either an inflow port or an outflow port. Depending on a rotational direction of the hydraulic motor 100, one of the ports 152 and 154 functions as an inflow port and the other functions as an outflow port. Further, drain ports 156 and 158 are respectively arranged outside the inflow/outflow ports 152 and 154.

A plurality of cylinder barrels 110 are rotatably supported together with a shaft 104 (axis) inside the housing 102. A piston 112 slidable in an axial direction of the shaft 104 is inserted into each of the plurality of the cylinder barrels. The pistons 112 are disposed along a circumferential direction of the cylinder barrel 110.

When hydraulic oil is supplied from an inflow port (one of the inflow/outflow ports 152 and 154), the piston 112 attempts to protrude from the cylinder barrel 110, thereby causing the cylinder barrel 110 to rotate. When the cylinder barrel 110 rotates, the piston 112 is pressed by a swash plate 120, and hydraulic fluid is discharged from an outflow port (the other one of the inflow/outflow ports 152 and 154).

The swash plate 120 is a member for changing strokes of the pistons 112. A head portion 112*a* of the piston 112 is attached to the swash plate 120 via a piston shoe 114 that abuts against and slides on the swash plate 120. An angle of the swash plate 120 is adjusted by a control piston 130. Specifically, the swash plate 120 is supported within the housing 102 so as not to rotate relative to the rotation of the shaft 104. In addition, the swash plate 120 is tilted when pressed by the control piston 130. Tilting of the swash plate 120 changes a stroke length of the piston 112.

Figure 2:
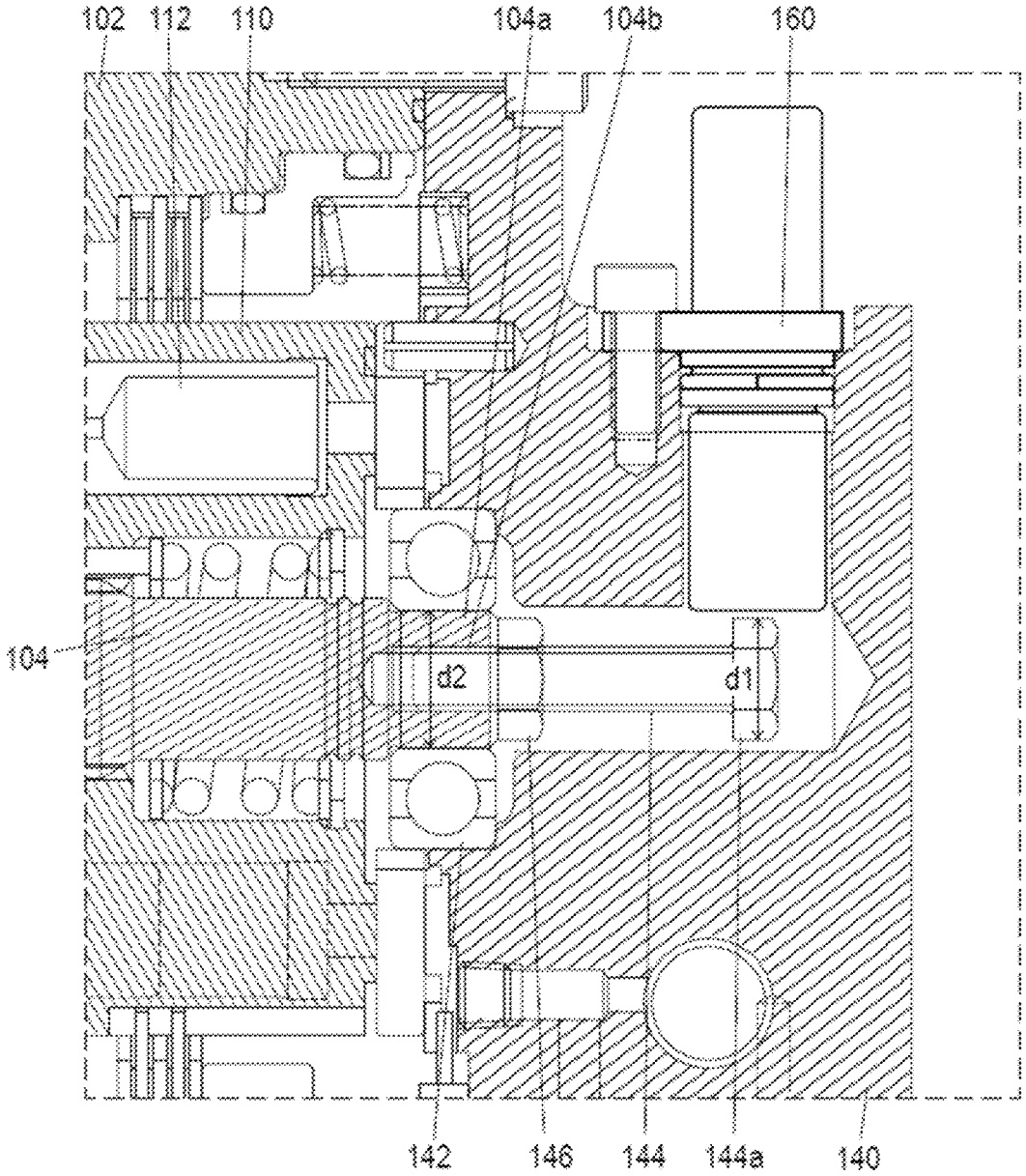
FIG. 2 is an enlarged view of a principal portion of FIG. 1A.

FIG. 2 is an enlarged view of a principal portion of FIG. 1B. In the valve body 140, an end portion 104*a* of the shaft 104 of the cylinder barrel 110 is supported by a bearing 142. A female thread 104*b* is formed in the end portion 104*a* of the shaft 104 on the valve body 140 side. A hexagonal bolt 144 as a shaft member is attached to the female thread 104*b*. The hexagonal bolt 144 has a hexagonal head 144*a* formed thereon. The hexagonal bolt 144 also serves as a shaft member having irregularities on an outer peripheral portion relative to an axis of the bolt. As an example of the irregularities on the outer peripheral portion, hexagonal irregularities of the head 144*a* can be cited. In addition, the hexagonal bolt 144 is fixed by a nut 146 functioning as a double nut.

As shown in FIGS. 1B and 2, a sensor 160 for detecting projections of irregularities of the shaft member is attached to the valve body 140. The sensor 160 detects, for example, the irregularities of the head 144*a* of the hexagonal bolt 144. As the sensor 160, a proximity sensor such as a magnetic type or an eddy-current type can be employed. By means of this sensor 160, a rotational speed of the motor can be detected.

Figure 3A:
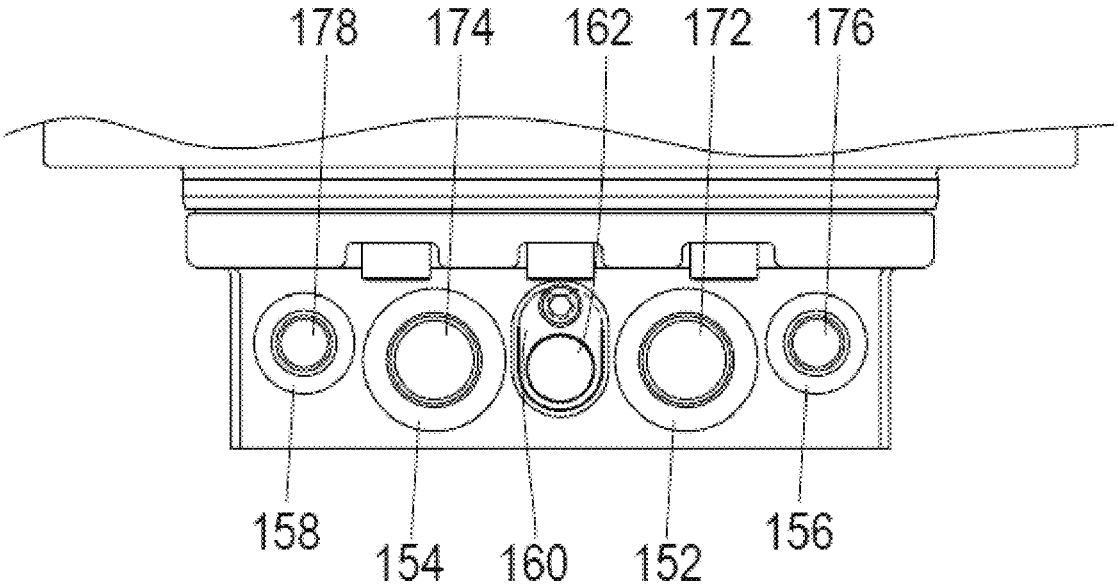
FIG. 3A is a diagram illustrating an arrangement of a sensor.
Figure 3B:
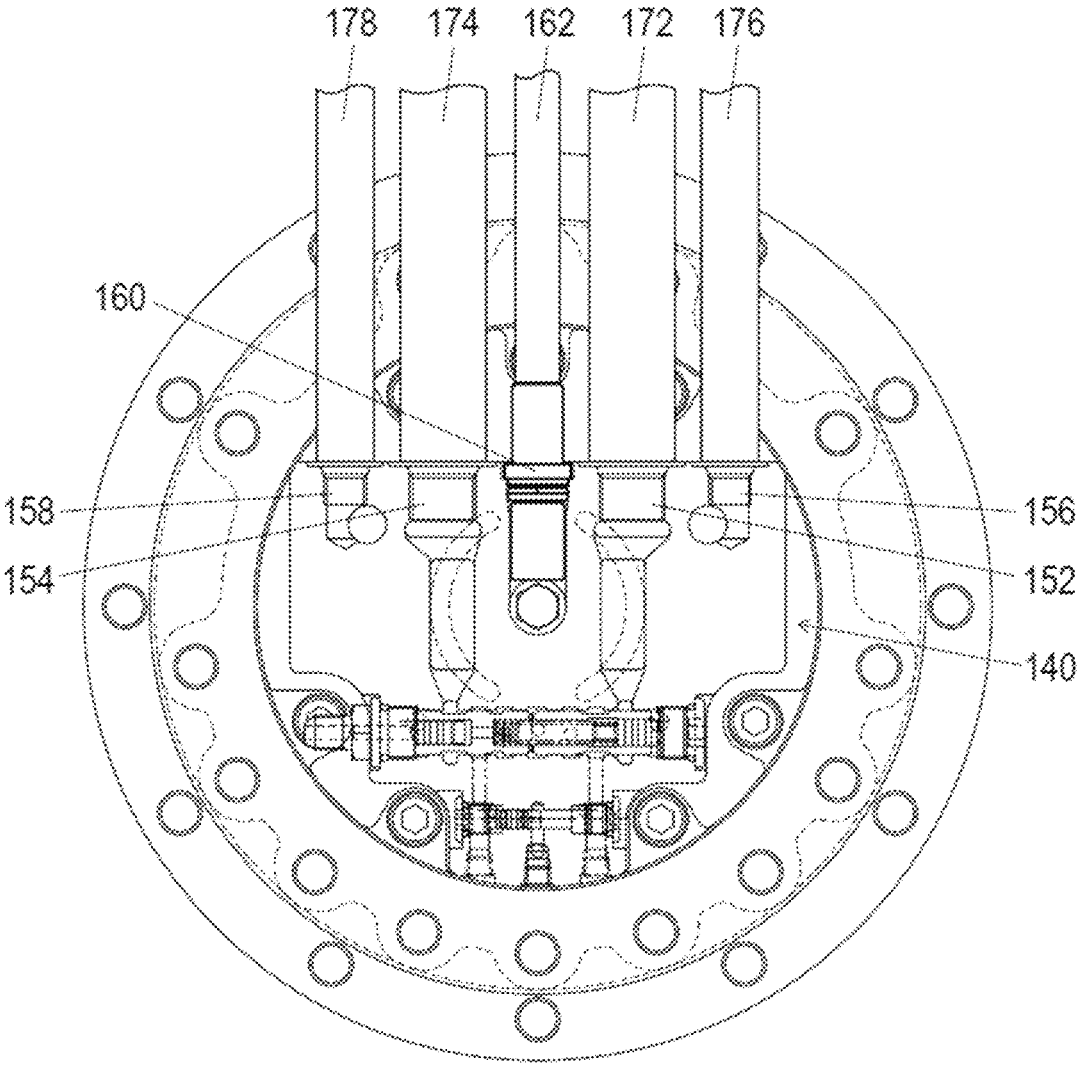
FIG. 3B is a front view of FIG. 1B as viewed from direction B.

FIG. 3A is a top view partially showing the valve body 140 of FIG. 1A. FIG. 3B is a front view of FIG. 1B observed from direction B. As shown in FIGS. 3A and 3B, the sensor 160 is arranged between the two inflow/outflow ports 152 and 154 (the inflow port and the outflow port).

According to the above configuration, the head 144*a* of the hexagonal bolt is arranged so as to protrude from the shaft 104. By arranging in this manner, the sensor 160 can be provided on the valve body 140. Furthermore, the sensor 160 is disposed at a position adjacent to the two inflow/outflow ports 152 and 154. Specifically, two inflow/outflow ports 152 and 154 are provided between two drain pipes 176 and 178, and the sensor 160 is disposed at a central portion therebetween, these components being arranged in a row. As a result, the positions of the hydraulic piping and the wiring of the sensor are aligned, thereby reducing restrictions on layout of the hydraulic motor 100.

As shown particularly in FIG. 3B, a connection direction of hydraulic pipes 172 and 174 of the two inflow/outflow ports 152 and 154 (the inflow port and the outflow port) is the same as a connection direction of the wiring 162 of the sensor 160. The two drain pipes 176 and 178 also have the same connection direction as the wiring 162 of the sensor 160 and the hydraulic pipes 172 and 174 of the two inflow/outflow ports 152 and 154. Accordingly, when the sensor 160 is provided, the wiring 162, the hydraulic pipes 172 and 174, and the drain pipes 176 and 178 can be routed together. Thus, efficiency in routing of the pipes and wiring can be improved.

Further, as shown in FIG. 2, in the hydraulic motor 100 according to the present embodiment, a maximum diameter d1 of the head 144*a* of the hexagonal bolt 144 (irregularities on the outer peripheral portion of the shaft member) is set smaller than a diameter d2 of the shaft.

Figure 4:
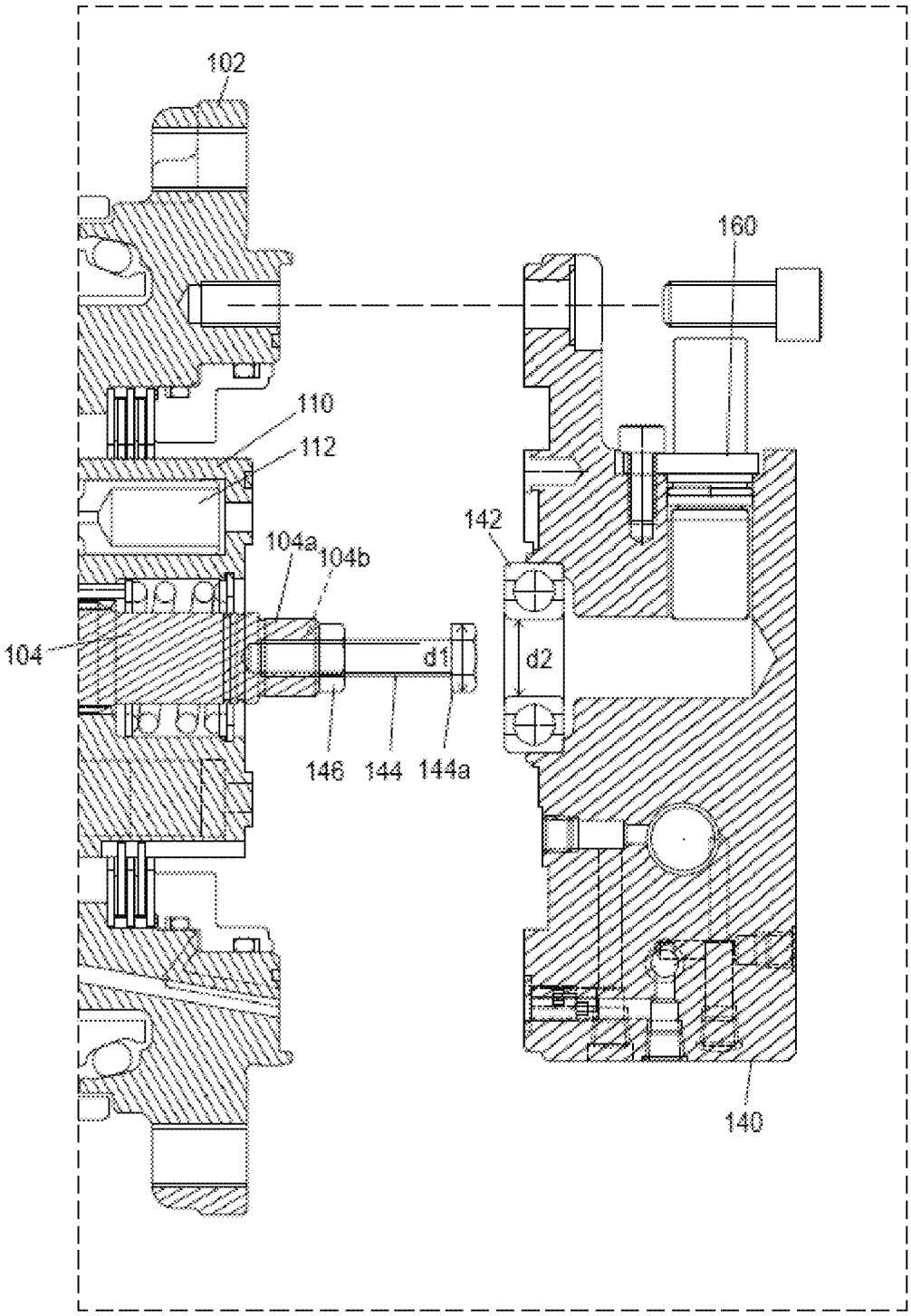
FIG. 4 is a diagram illustrating a state in which a valve body is removed.

FIG. 4 is a diagram illustrating a state in which the valve body 140 is removed. As shown in FIG. 4, when removing the valve body 140 from the housing 102, the head of the hexagonal bolt 144 can pass through the inner ring of the bearing 142 that supports the shaft 104. Therefore, the valve body 140 can be easily removed.

As described above, the valve body 140 is removed to expose the hexagonal bolt 144. This allows the hexagonal bolt 144 to be rotated so that a position of its head 144*a* can be easily adjusted to a position where it can be readily detected by the sensor 160. In other words, in addition to fixing a structural component on the valve body end side of the hydraulic motor 100 with the nut 146, the hexagonal bolt 144 is caused to protrude axially from the nut 146. Furthermore, the irregularities (for example, the head 144*a*) are provided on the protruding side. With this configuration, fine adjustment of an axial position of a detection target portion of the sensor 160 can be achieved. It should be noted that as a detection target portion of the sensor 160, another configuration having irregularities may also be employed. As one example, a male spline can be cited.

As described above, a preferred embodiment of the present invention has been described with reference to the accompanying drawings, but it goes without saying that the present invention is not limited to such an example. It is apparent that those skilled in the art can conceive of various modifications or alterations within the scope described in the claims, and it is to be understood that these are naturally included in the technical scope of the present invention.

What I claim is:

1. A hydraulic motor comprising:

a cylinder barrel rotatably supported in a housing together with a shaft;

a plurality of pistons slidably inserted in an axial direction into the cylinder barrel;

a swash plate for changing strokes of the pistons;

a control piston for adjusting an angle of the swash plate;

a valve body provided with an inflow port and an outflow port;

a female thread formed at an end portion of the shaft of the cylinder barrel on the valve body side;

a shaft member having irregularities on an outer peripheral portion and attached to the female thread; and a sensor arranged between the inflow port and the outflow port and detecting the irregularities of the shaft member.

2. The hydraulic motor according to claim 1, wherein a connection direction of hydraulic piping of the inflow port and the outflow port and a connection direction of wiring of the sensor are the same.

3. The hydraulic motor according to claim 1, wherein a maximum diameter of the irregularities on the outer peripheral portion of the shaft member is smaller than a diameter of the shaft.

* * * * *